US006387015B1

(12) United States Patent
Watson

(10) Patent No.: US 6,387,015 B1
(45) Date of Patent: May 14, 2002

(54) EXERCISE APPARATUS EMPLOYING COUNTER-RESISTIVE TREADING MECHANISM

(76) Inventor: Neil Watson, 3705 Oldmill Dr., Flower Mound, TX (US) 75028

( * ) Notice: Subject to any disclaimer, the term of this patent is extended or adjusted under 35 U.S.C. 154(b) by 0 days.

(21) Appl. No.: 09/573,150

(22) Filed: May 17, 2000

Related U.S. Application Data

(60) Provisional application No. 60/152,328, filed on Sep. 7, 1999.

(51) Int. Cl.[7] ..... A63B 22/02
(52) U.S. Cl. ..... 482/54; 482/103; 482/113
(58) Field of Search ..... 482/51, 54, 93, 482/94, 98–103, 112, 113, 129, 133, 138, 908

(56) References Cited

U.S. PATENT DOCUMENTS 5,860,894 A * 1/1999 Dalebout et al. ..... 482/54
5,951,449 A * 9/1999 Oppriecht ..... 482/54

* cited by examiner

*Primary Examiner*—Glenn E. Richman
(74) *Attorney, Agent, or Firm*—Burleigh & Associates; Roger S. Burleigh

(57) ABSTRACT

Exercise apparatus, and methods of use thereof. The apparatus can include a lower frame structure having forward and rearward portions; an upper frame structure extending upwardly from the forward portion of the lower frame structure; a forward engagement structure coupled to an upper portion of the upper frame structure; and a counter-resistive treading mechanism supported by the lower frame structure. In use, a user of the apparatus engages the forward engagement structure with an upper body portion of the user; engages the counter-resistive treading mechanism with the feet of the user; and displaces the counter-resistive treading mechanism by pushing rearwardly with the user's feet. The counter-resistive treading mechanism at least partially opposes the rearward displacement of the feet of the user as the user exerts a force against the forward engagement structure and the counter-resistive treading mechanism, whereby the force generated by the user's legs to rearwardly displace the counter-resistive mechanism is transmitted through the user's upper body to the forward engagement structure, thereby allowing for a substantially full-body workout of the user.

20 Claims, 2 Drawing Sheets

EXERCISE APPARATUS EMPLOYING COUNTER-RESISTIVE TREADING MECHANISM

RELATED APPLICATION

The Applicant hereby claims the benefits of U.S. Provisional Patent Application Ser. No. 60/152,328, filed on Sep. 7, 1999.

TECHNICAL FIELD OF THE INVENTION

The present invention is directed, in general, to exercise apparatus and, more specifically, to an exercise apparatus employing a moveable counter-resistive treading mechanism.

BACKGROUND OF THE INVENTION

Because exercise treadmills can be used regardless of outdoor weather conditions, they are very popular for indoor aerobic exercise sessions. In addition, some people like to be distracted during an exercise session, thus, exercise treadmills are often desired to be positioned in a living area near a television set, perhaps setting a goal of working through a half-hour program.

One goal of exercise is to enhance the strength and endurance of skeletal muscles. Another goal is to enhance the capacity and endurance of, for example, the heart and lungs. Exercises are sometimes categorized according to their relative purpose or effectiveness in achieving a particular goal. For purposes of this application, those exercises most effective in strengthening skeletal muscles may be termed anaerobic or strength-conditioning exercises. Strength-conditioning exercises are also sometimes called weight-training exercises. Those that are most effective in enhancing cardiovascular performance, or the condition of the heart and lungs, may be termed aerobic exercises. It is usually desirable to include both aerobic and anaerobic exercises in an exercise program.

Aerobic exercises rely generally on rapid and extended repetitions of an exercise movement against low to moderate resistance. Running and jogging are examples of what are typically regarded as aerobic exercises. Treadmills and stepper-type machines are examples of machines for performing running, stepping or jogging-type exercises.

Anaerobic exercises for muscle conditioning are usually performed by making a relatively few repetitive movements or repetitions against high resistance. Typically, anaerobic exercises involve a more static type of exercise in which the user pushes or pulls against a force that can be selected or adjusted consistent with the user's physical ability. For example, the exerciser may work against gravitational resistance by lifting free weights, or by lifting weights through an arrangement of pulleys, to develop increased strength. Weight machines are known which provide adjustable resistance for a selection of anaerobic exercises using different muscles and limbs. Such machines may include a bench portion so the user may recline to do, for example, press exercises, or sit to do, for example, leg lift exercises. Examples include the machines described in U.S. Pat. Nos. 4,809,972 (Rasmussen, et al.); 4,898,381 (Gordon); 4,902,006 (Stallings); 4,861,025 (Rockwell); 4,799,671 (Hoggan, et al.); 4,930,768 (Lapcevic); 4,919,419 (Houston); 4,915,379 (Sapp); 4,900,018 (Ish, et al.); and 4,915,377, 4,744,559 and 4,678,185 (Mahnke).

For many users, a home exercise apparatus greatly facilitates the regular performance of an exercise program. It is, furthermore, highly desirable to have a single machine useful for both anaerobic and aerobic conditioning. Exercise machines that combine both aerobic and anaerobic exercise functions are known. For example, U.S. Pat. No. 4,477,071 (Brown et al.) discloses a rowing machine (aerobic) that can be reconfigured and used for performing anaerobic exercises. U.S. Pat. Nos. 4,796,881 and 4,750,736 (Watterson) both disclose a rowing exerciser with a weight bench structure for anaerobic or strength exercises. U.S. Pat. No. 4,705,267 (Jackson) discloses a machine having a weight bench portion, a bicycle wind trainer and a rowing machine. In an exercise device illustrated in U.S. Pat. No. 881,521 (Wilson), a mechanical chair was adapted to convert into a variety of exercise devices, such as an inclined roller section, rowing machine and handle exercise assembly. Although such prior art exercise apparatus do provide for both aerobic and anaerobic exercises, the anaerobic exercises are generally limited to only a few muscle groups, rather than the whole body, or the apparatus must be reconfigured each time it is desired to work a different muscle group.

Accordingly, there is a need in the art for an exercise apparatus that can provide for both aerobic and anaerobic exercises. There is a further need in the art for an exercise apparatus that can provide a substantially full body workout without requiring significant reconfiguration.

SUMMARY OF THE INVENTION

To address the above-discussed deficiencies of the prior art, the present invention relates to an exercise apparatus employing a moveable counter-resistive structure. In general embodiments, the apparatus includes a lower frame structure having forward and rearward portions; an upper frame structure extending upwardly from the forward portion of the lower frame structure; a forward engagement structure coupled to an upper portion of the upper frame structure; and a counter-resistive treading mechanism supported by the lower frame structure. In use, a user of the apparatus engages the forward engagement structure with an upper body portion of the user; engages the counter-resistive treading mechanism with the feet of the user; and displaces the counter-resistive treading mechanism by pushing rearwardly with the user's feet.

Those skilled in the art recognize that the term "resistance" refers to an opposing or retarding force to the displacement of a physical body. As used herein, "counter-resistive" is defined as a resistance in an opposite direction to the direction of force exerted by a user to rearwardly displace the treading mechanism; i.e. the counter-resistive treading mechanism opposes any rearward displacement. The counter-resistive feature of the present invention is in contrast to conventional treadmills, which are not designed to resist the rearward displacement of the tread surface; in fact, many conventional treadmills are motorized and automatically displace the tread surface in a rearward direction, which forces a user to walk or run at a pace that is a function of the speed at which the tread surface is moving.

The counter-resistive treading mechanism includes a resistance mechanism, which, in various alternative embodiments, can be a frictional, magnetic, or hydraulic resistance mechanism. The counter-resistive treading mechanism at least partially opposes the rearward displacement of the feet of the user as the user exerts a force against the forward engagement structure and the counter-resistive treading mechanism, whereby the force generated by the user's legs to rearwardly displace the counterresistive treading mechanism is transmitted through the user's upper body to the forward engagement structure, thereby allowing for a substantially full-body workout of the user.

In an exemplary embodiment described in detail hereinafter, the exercise apparatus is a modified conventional treadmill, having a counter-resistive treading mechanism for opposing the displacement of the tread, and a push handle or pressure pad. A user can grasp the push handle, or place their shoulder or back against the pressure pad, while simultaneously moving their legs to displace the tread. Because the displacement of the tread is retarded, or opposed, by the counter-resistive mechanism, the user is involved in an anaerobic exercise. The force generated by the user's legs is transmitted not only to the tread, but also up through the user's torso to the pressure pad, or torso and arms to the push handle, thereby allowing for a substantially full-body workout. The counter-resistive treading mechanism can be disabled to allow the treadmill to be used for aerobic exercises, such as treading or running.

The foregoing has outlined, rather broadly, the principles of the present invention so that those skilled in the art may better understand the detailed description of the exemplary embodiments that follow. Those skilled in the art should appreciate that they can readily use the disclosed conception and exemplary embodiments as a basis for designing or modifying other structures and methods for carrying out the same purposes of the present invention. Those skilled in the art should also realize that such equivalent constructions do not depart from the spirit and scope of the invention in its broadest form, and all such constructions are intended to be within the scope of the claims recited hereinafter, and equivalents thereof.

BRIEF DESCRIPTION OF THE DRAWINGS

The accompanying drawings are incorporated into and form a part of the specification to provide illustrative examples of the present invention. These drawings, together with the detailed description, serve to explain the principles of the invention. The drawings are only for purposes of illustrating preferred and alternate embodiments of how the invention can be made and used and are not to be construed as limiting the invention to only the illustrated and described examples. Various advantages and features of the present invention will be apparent from a consideration of the accompanying drawings in which:

FIG. 2-B is a rear view of the second exemplary embodiment of an exercise apparatus employing a counter-resistive treading mechanism.

DETAILED DESCRIPTION

Figure 1:
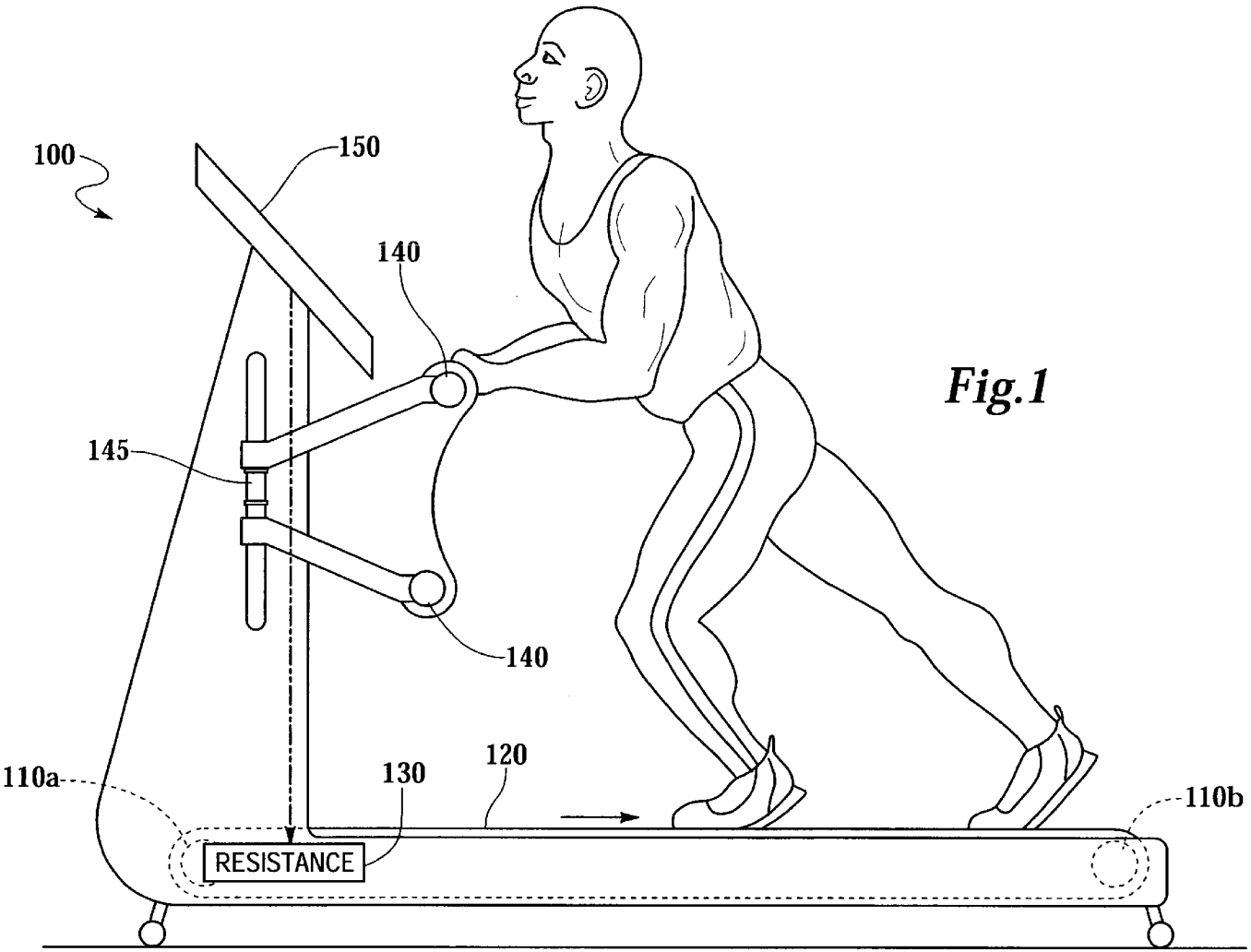
FIG. 1 is a side view illustrating a first exemplary embodiment of an exercise apparatus employing a counter-resistive treading mechanism.

Referring to FIG. 1, illustrated is a side view of a first exemplary exercise apparatus 100 employing a counter-resistive treading mechanism. T he exercise apparatus 100 is based on a conventional treadmill design, having rotatable drums, or cylinders, 110-A and 110-B and a continuous treading surface 120. In a conventional non-motorized treadmill, the rotatable drums 110-A and 110-B are freely rotatable, whereby a user can walk or run on the treadmill. In a conventional motorized treadmill, a motor is coupled to at least one of the rotatable drums 110-A and 110-B; a user can adjust the velocity of the motor to control the linear velocity of the treading surface 120 to match a desired speed for walking or running According to the principles of the present invention, a resistance mechanism 130 is coupled to at least one of the rotatable drums 111-A and 110-B; the resistance means 130 acts to resist the rearward displacement of the treading surface 120. Many different mechanisms are known in the art that are suitable to perform the function demanded of the resistance mechanism 130; such mechanisms may be based, for example, on friction, hydraulic, magnetic, or electro-magnetic technology.

The principles of the present invention are not limited to a particular type of resistance mechanism, all such mechanisms being substantially equivalent for the general purposes of the present invention. Those skilled in the art, however, will recognize that a controllable resistance mechanism is preferable; a controllable resistance mechanism allows the operational characteristics of the exercise apparatus 100 to be adjusted to the physical abilities of individual users, and/or to vary the degree of counter-resistance during each stride or over the duration of a session of use. Controllable resistance mechanisms are also known to those skilled in the art, and a detailed description herein is not necessary to an understanding of the features and operation of the present invention.

The exercise apparatus 100 further includes at least one push bar 140. During use of the exercise apparatus 100, a user stands on the treading surface 120 and grasps a push bar 140. Because the rearward displacement of the treading surface 120 is opposed by the resistance mechanism 130, the user's legs must exert a rearward pushing force that is a function of the degree of resistance restricting the displacement of the treading surface 120. Because for every action there is an equal and opposite reaction, the pushing force generated by the user's legs is countered by forces directed through the user's torso and arms and applied to the push bar 140. Thus, the exercise apparatus 100 is suitably operative to simultaneously provide a substantially full-body workout of a user's major muscle groups.

The resistance mechanism 130 and the positioning of the push bar 140 are preferably adjustable, whereby the treadmill apparatus 100 can be tailored to the size of different users and to different desired exercises. In a preferred embodiment, the resistance mechanism 130 is controllable by a computer 150. By controlling the degree of resistance provided by the resistance mechanism 130, the exercise apparatus 100 can be used to simulate the conditions of certain sports-specific movements. For example, football players often practice blocking by pushing a weighted sled, and bobsledders must be able to quickly accelerate a bobsled by pushing it. In such cases, the athlete's movements are initially restricted by static friction forces that are greater than the dynamic friction forces encountered once the body being pushed is in motion. Thus, the exercise apparatus 100 can be used to simulate such sports-specific movements by programming the computer 150 to controllably vary the degree of resistance provided by the resistance mechanism 130 as a function of time or displacement of the treading surface 120. The computer 150 can also be used to display information to a user, such as heart rate, calories expended, pushing force, etc. Those skilled in the art are familiar with the use of computers in combination with exercise apparatus, and will appreciate the capability to use such computers to control the operation of such apparatus and display various information to users; the principles of the present invention are not limited to any particular control function or information display capabilities.

In certain embodiments, the push handle 140 may be coupled to the exercise apparatus 100 through a shock-absorbing means 145. A shock-absorbing means can be, for example, a hydraulic or spring coupling suitable to absorb the initial pushing force generated by a user, thereby reducing the degree of shock sustained by a user's arms.

Figure 2A:
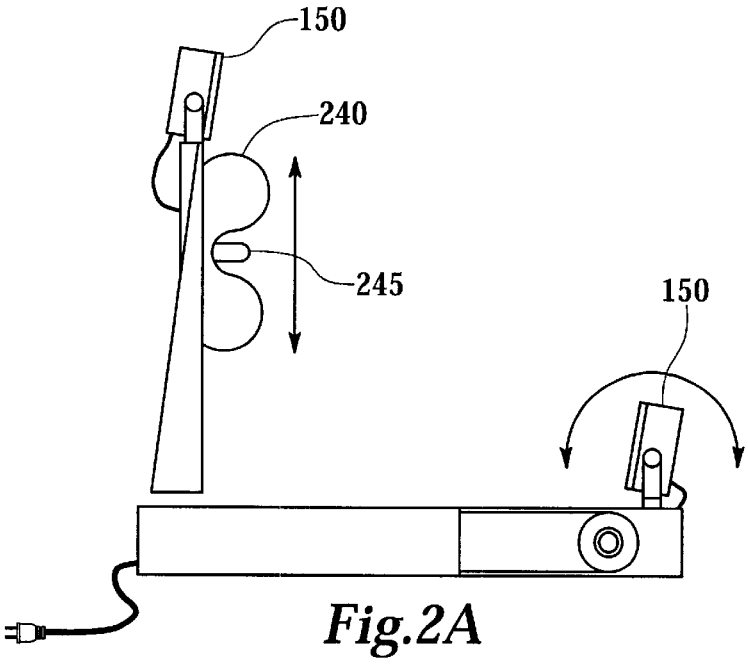
FIG. 2-A is a side view of a second exemplary embodiment of an exercise apparatus employing a counter-resistive treading mechanism.
Figure 2B:
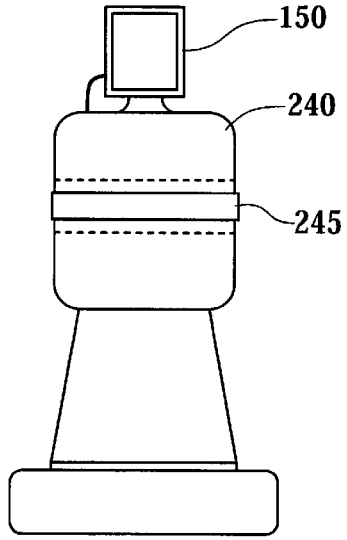

Referring now to FIGS. 2-A and 2-B, illustrated are a side view and a rear view, respectively, of a second exemplary exercise apparatus 200. The exercise apparatus 200 is substantially similar to the exercise apparatus 100, except that the push bar 140 has been replaced by a pressure pad 240; a push bar 245 can also be provided. A pressure pad is desirable for certain exercises in which a user engages the pressure pad 240 with either their shoulder or their back. Engaging the pressure pad 240 with their shoulder, for example, a user can simulate the sports-specific movements associated with blocking—ordinarily practiced using a weighted sled. In another exercise, a user can face away from the pressure pad 245 and engage the pad with their back, thus emphasizing the use of certain different lower-body muscle groups. In preferred embodiments, an exercise apparatus in accordance with the principles disclosed herein can have an interchangeable push bar and pressure pad, or a configuration with both a pressure pad and push bar.

As with exercise apparatus 100, exercise apparatus 200 also preferably includes a computer 150. Whereas a user may use the exercise apparatus 200 in either a forward- and rearward-facing position, a computer 150 is preferably provided at either end or, alternatively, the computer 150 can be provided with means to allow it to be interchangeably mounted to either end.

The principles of the present invention can be implemented in an apparatus strictly limited to providing the counter-resistive treading functions disclosed herein or, preferably, can be added to the functions provided by a conventional treadmill. For example, a conventional motorized treadmill apparatus can be modified to include a resistance mechanism 130. When it is desired to use the apparatus for walking or running, the motor can be enabled and the resistance mechanism 130 disabled; conversely, when it is desired to use the apparatus as described herein, the motor can be disabled and the resistance mechanism 130 enabled. Furthermore, a conventional treadmill apparatus can be modified to provide a coupling to mount a push bar 140 or pressure pad 240. In a particular embodiment, a conventional treadmill having balance bars for walking or running at one end thereof can include a push bar or pressure pad at the other end, thereby eliminating the need to manually reconfigure the apparatus for different exercise uses; i.e., the treading surface 120 can be configured to operate in either direction depending on the mode of use.

Figure 3:
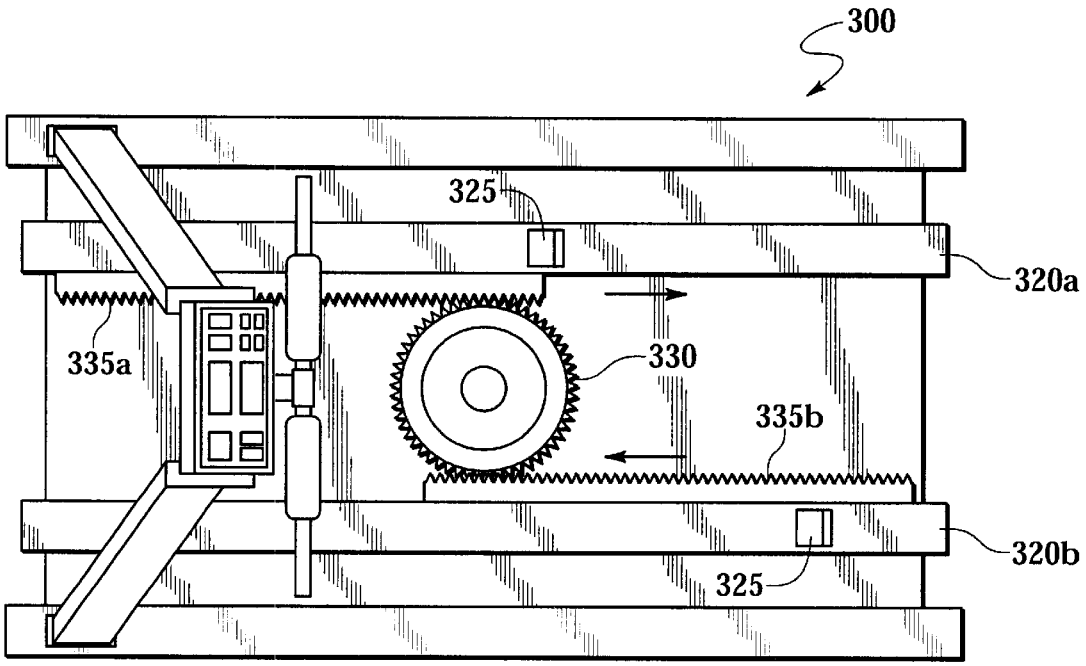
FIG. 3 is a top view of a third exemplary embodiment of an exercise apparatus employing a counter-resistive treading mechanism.

Turning now to FIG. 3, illustrated is a top view of a third exemplary embodiment of an exercise apparatus 300 employing a counter-resistive treading mechanism. In place of a conventional treadmill structure and resistance mechanism as illustrated in FIGS. 1 and 2-*a*, exercise apparatus 300 has a counter-resistive treading mechanism characterized by independent slidable tracks 320-*a* and 320-*b*. Each track 320-*a* and 320-*b* preferably includes a foot retention structure 325 for engaging the feet of a user; a suitable foot retention structure should at least prevent a user's foot from rearward slippage.

In the illustrated embodiment, a counter-resistive mechanism includes a rotatable gear 330 intermediate to and engaging geared members 335-*a* and 335-*b* coupled longitudinally to each slidable track 320-*a* and 320-*b*, respectively. The rotatable gear 330 and geared members 335-*a* and 335-*b* cooperate such that slidable track 320-*b* is forwardly displaced when slidable track 320-*a* is rearwardly displaced, and vice versa. The opposing displacement of the slidable tracks 320-*a* and 320-*b* corresponds to the treading movements of a user's legs.

To oppose the displacement of the slidable tracks 320-*a* and 320-*b*, a resistance mechanism (not shown) can be coupled to the rotatable gear 330. As previously described, many different mechanisms are known in the art that are suitable to perform the function demanded of the resistance mechanism; such mechanisms may be based, for example, on friction, hydraulic, magnetic, or electro-magnetic technology.

The present invention provides significant advantages to exercise apparatus, in general, and the invention is particularly advantageous for use in certain sports-specific exercises. For example, exercise apparatus in accordance with the principles disclosed herein can be used to simulate blocking actions performed by football players, and sled pushing actions performed by bobsledders. Those skilled in the art will also appreciate the advantages of the present invention for general physical conditioning, due to the ability to provide a substantially full-body workout using a single apparatus.

Although the principles of the invention have been described in detail, those skilled in the art will conceive of various changes, substitutions and alterations to the exemplary embodiments described herein without departing from the spirit and scope of the invention in its broadest form. The exemplary embodiments presented herein illustrate the principles of the invention and are not intended to be exhaustive or to limit the invention to the form disclosed; it is intended that the scope of the invention be defined only by the claims recited hereinafter, and equivalents thereof.

What is claimed is:

1. An exercise apparatus comprising:

a lower frame structure having forward and rearward portions;

an upper frame structure extending upwardly from said forward portion of said lower frame structure;

a forward engagement structure coupled to an upper portion of said upper frame structure, said forward engagement structure operative to be engaged by an upper body portion of a user of said exercise apparatus; and a counter-resistive treading mechanism supported by said lower frame structure, said counter-resistive treading mechanism operative to be engaged by the feet of a user of said exercise apparatus, said counter-resistive treading mechanism at least partially opposing the rearward displacement of the feet of said user as said user exerts a force against said forward engagement structure, whereby the force generated by the user's legs to rearwardly displace the counter-resistive treading mechanism is transmitted through the user's upper body to the forward engagement structure, thereby allowing for a substantially full-body workout of said user.

2. The exercise apparatus recited in claim 1, wherein said counter-resistive treading mechanism comprises:

a continuous treading surface; and a resistance mechanism, said resistance mechanism opposing said rearward displacement of an upper surface of said continuous treading surface.

3. The exercise apparatus recited in claim 2, wherein said continuous treading surface comprises a flexible belt, said apparatus further comprising first and second rotatable drums at forward and rearward internal locations of said flexible belt, said flexible belt extending between said first and second rotatable drums to form said continuous treading surface.

4. The exercise apparatus recited in claim 2, wherein said resistance mechanism comprises a rotational friction mechanism.

5. The exercise apparatus recited in claim 2, wherein said resistance mechanism comprises a magnetic resistance mechanism.

6. The exercise apparatus recited in claim 2, wherein said resistance mechanism comprises a hydraulic resistance mechanism.

7. The exercise apparatus recited in claim 1, wherein said forward engagement structure comprises a surface to be engaged by a shoulder or back of a user of said exercise apparatus, whereby the force generated by the user's legs to rearwardly displace the counter-resistive treading mechanism is transmitted through the user's torso to the forward engagement structure.

8. The exercise apparatus recited in claim 1, wherein said forward engagement structure comprises a bar to be engaged by the hands a user of said exercise apparatus, whereby the force generated by the user's legs to rearwardly displace the counter-resistive treading mechanism is transmitted through the user's torso and arms to the forward engagement structure.

9. A method of using an exercise apparatus, said method comprising the steps of:

engaging a forward engagement structure with an upper body portion of a user of said exercise apparatus;

engaging a counter-resistive treading mechanism with the feet of a user of said exercise apparatus; and displacing said counter-resistive treading mechanism by said user pushing rearwardly with said user's feet, said counter-resistive treading mechanism at least partially opposing the rearward displacement of the feet of said user as said user exerts a force against said forward engagement structure and said counter-resistive treading mechanism, whereby the force generated by the user's legs to rearwardly displace the counter-resistive treading mechanism is transmitted through the user's upper body to the forward engagement structure, thereby allowing for a substantially full-body workout of said user.

10. The method of using an exercise apparatus recited in claim 9, wherein said moveable counter-resistive treading mechanism comprises:

a continuous treading surface; and a resistance mechanism, said resistance mechanism opposing said rearward displacement of an upper surface of said continuous treading surface.

11. The method of using an exercise apparatus in claim 10, wherein said continuous treading surface comprises a flexible belt extended around first and second rotatable drums at forward and rearward internal locations of said flexible belt, said flexible belt extending between said first and second rotatable drums to form said continuous treading surface.

12. The method of using an exercise apparatus recited in claim 10, wherein said resistance mechanism is selected from the group consisting of:

a rotational friction mechanism;

a magnetic resistance mechanism; and a hydraulic resistance mechanism.

13. The method of using an exercise apparatus recited in claim 9, wherein said step of engaging a forward engagement structure with an upper body portion of a user of said exercise apparatus comprises the step of engaging a surface with a shoulder or back of a user of said exercise apparatus, whereby the force generated by the user's legs to rearwardly displace the counter-resistive treading mechanism is transmitted through the user's torso to the forward engagement structure.

14. The method of using an exercise apparatus recited in claim 9, wherein said step of engaging a forward engagement structure with an upper body portion of a user of said exercise apparatus comprises the step of engaging a bar with the hands a user of said exercise apparatus, whereby the force generated by the user's legs to rearwardly displace the counter-resistive treading mechanism is transmitted through the user's torso and arms to the forward engagement structure.

15. A method of using an exercise apparatus having a lower frame structure having forward and rearward portions; an upper frame structure extending upwardly from said forward portion of said lower frame structure; a forward engagement structure coupled to an upper portion of said upper frame structure; and a counter-resistive treading mechanism supported by said lower frame structure; said method comprising the steps of:

engaging said forward engagement structure with an upper body portion of a user of said exercise apparatus;

engaging said counter-resistive treading mechanism with the feet of a user of said exercise apparatus; and displacing said counter-resistive treading mechanism by said user pushing rearwardly with said user's feet, said counter-resistive treading mechanism at least partially opposing the rearward displacement of the feet of said user as said user exerts a force against said forward engagement structure and said counter-resistive treading mechanism, whereby the force generated by the user's legs to rearwardly displace the counter-resistive treading mechanism is transmitted through the user's upper body to the forward engagement structure, thereby allowing for a substantially full-body workout of said user.

16. The method of using an exercise apparatus recited in claim 15, wherein said counter-resistive treading mechanism comprises:

a continuous treading surface; and a resistance mechanism, said resistance mechanism opposing said rearward displacement of an upper surface of said continuous treading surface.

17. The method of using an exercise apparatus in claim 16, wherein said continuous treading surface comprises a flexible belt extended around first and second rotatable drums at forward and rearward internal locations of said flexible belt, said flexible belt extending between said first and second rotatable drums to form said continuous treading surface.

18. The method of using an exercise apparatus recited in claim 16, wherein said resistance mechanism is selected from the group consisting of:

a rotational friction mechanism;

a magnetic resistance mechanism; and a hydraulic resistance mechanism.

19. The method of using an exercise apparatus recited in claim 15, wherein said step of engaging a forward engagement structure with an upper body portion of a user of said exercise apparatus comprises the step of engaging a surface with a shoulder or back of a user of said exercise apparatus, whereby the force generated by the user's legs to rearwardly displace the counter-resistive treading mechanism is transmitted through the user's torso to the forward engagement structure.

20. The method of using an exercise apparatus recited in claim 15, wherein said step of engaging a forward engagement structure with an upper body portion of a user of said exercise apparatus comprises the step of engaging a bar with the hands a user of said exercise apparatus, whereby the force generated by the user's legs to rearwardly displace the counter-resistive treading mechanism is transmitted through the user's torso and arms to the forward engagement structure.

* * * * *